US008855350B2

(12) United States Patent
Miller, III

(10) Patent No.: US 8,855,350 B2
(45) Date of Patent: Oct. 7, 2014

(54) PATTERNED IMPLANTABLE ELECTRET MICROPHONE

(75) Inventor: Scott Allan Miller, III, Lafayette, CO (US)

(73) Assignee: Cochlear Limited, Macquarie University (AU)

( * ) Notice: Subject to any disclaimer, the term of this patent is extended or adjusted under 35 U.S.C. 154(b) by 1169 days.

(21) Appl. No.: 12/768,581

(22) Filed: Apr. 27, 2010

(65) Prior Publication Data

US 2010/0272287 A1 Oct. 28, 2010

Related U.S. Application Data

(60) Provisional application No. 61/173,275, filed on Apr. 28, 2009.

(51) Int. Cl.

| | |
|---|---|
| ***H04R 9/08*** | (2006.01) |
| ***H04R 11/04*** | (2006.01) |
| ***H04R 25/00*** | (2006.01) |
| ***H04R 19/01*** | (2006.01) |

(52) U.S. Cl.

CPC ..... *H04R 19/016* (2013.01); *H04R 2225/67* (2013.01)

USPC ..... 381/355; 381/170; 381/174; 600/25

(58) Field of Classification Search

CPC .... H04R 19/00; H04R 19/005; H04R 19/016; H04R 19/04; H04R 21/02; H04R 3/00; H04R 3/005; H04R 25/606; A61N 1/36032; A61N 1/0541

USPC ..... 381/87, 91, 92, 355, 122, 312–313, 381/111, 113–114, 150, 170, 181, 174, 381/191; 600/25

See application file for complete search history.

(56) References Cited

U.S. PATENT DOCUMENTS

| | | | | |
|---|---|---|---|---|
| 3,118,022 | A | | 1/1964 | Sessler et al. |
| 3,436,492 | A | | 4/1969 | Reedyk |
| 3,821,492 | A | | 6/1974 | Tamura et al. |
| 3,835,264 | A | | 9/1974 | Overby |
| 3,946,422 | A | | 3/1976 | Yagi et al. |
| 4,188,513 | A | * | 2/1980 | Morrell et al. ..... 381/111 |
| 4,329,547 | A | | 5/1982 | Imai |
| 4,447,678 | A | | 5/1984 | Fidi |

(Continued)

FOREIGN PATENT DOCUMENTS

| | | | |
|---|---|---|---|
| EP | 1259094 | A2 | 11/2002 |
| WO | 2006/076531 | A2 | 7/2006 |
| WO | 2006/095946 | A1 | 9/2006 |

*Primary Examiner* — Xu Mei

(74) *Attorney, Agent, or Firm* — Lowe Hauptman & Ham, LLP

(57) ABSTRACT

An implantable microphone that includes a hermetically-sealed, enclosed volume and an electret member and back plate disposed with a space therebetween and capacitively coupleable to provide an output signal indicative of acoustic signals incident upon at least one of the electret member and back plate. At least one of the electret member and the back plate may include a plurality of laterally offset portions located in corresponding spatial relation to a plurality of laterally offset regions including the lateral extent of the space. The output signal may be at least one of weighted and weightable in relation to the plurality of laterally offset portions. The electret member may include the plurality of laterally offset portions, and the laterally offset portions may include at least one positively charged dielectric material portion and at least one negatively charged dielectric material portion.

24 Claims, 8 Drawing Sheets

(56) References Cited

U.S. PATENT DOCUMENTS

| | | | | |
|---|---|---|---|---|
| 4,922,471 | A | 5/1990 | Kuehnel | |
| 5,101,543 | A | 4/1992 | Cote et al. | |
| 5,862,239 | A * | 1/1999 | Kubli et al. | 381/356 |
| 5,881,158 | A | 3/1999 | Lesinski et al. | |
| 6,093,144 | A | 7/2000 | Jaeger et al. | |
| 6,422,991 | B1 | 7/2002 | Jaeger | |
| 6,516,228 | B1 | 2/2003 | Berrang et al. | |
| 6,626,822 | B1 | 9/2003 | Jaeger et al. | |
| 6,648,813 | B2 | 11/2003 | Zilberman et al. | |
| 6,694,032 | B2 | 2/2004 | Yun et al. | |
| 6,707,920 | B2 | 3/2004 | Miller | |
| 6,736,771 | B2 | 5/2004 | Sokolich et al. | |
| 6,806,593 | B2 | 10/2004 | Tai et al. | |
| 7,003,127 | B1 | 2/2006 | Sjursen et al. | |
| 7,065,224 | B2 | 6/2006 | Cornelius et al. | |
| 7,136,496 | B2 | 11/2006 | Van Halteren et al. | |
| 7,206,423 | B1 | 4/2007 | Feng et al. | |
| 7,292,696 | B2 | 11/2007 | Saeki et al. | |
| 7,728,779 | B2 | 6/2010 | Korner | |
| 7,903,836 | B2 * | 3/2011 | Miller et al. | 381/361 |
| 7,955,250 | B2 * | 6/2011 | Jaeger et al. | 600/25 |
| 8,200,339 | B2 | 6/2012 | Wiskerke et al. | |
| 8,448,326 | B2 | 5/2013 | Sinclair | |
| 2001/0033670 | A1 | 10/2001 | Tai et al. | |
| 2002/0124656 | A1 | 9/2002 | McIntosh | |
| 2002/0172385 | A1 | 11/2002 | Tanabe et al. | |
| 2003/0035558 | A1 | 2/2003 | Kawamura et al. | |
| 2004/0039245 | A1 | 2/2004 | Jaeger et al. | |
| 2004/0109579 | A1 | 6/2004 | Izuchi et al. | |
| 2005/0084128 | A1 | 4/2005 | Niederdraenk | |
| 2005/0261544 | A1 | 11/2005 | Gan | |
| 2006/0177083 | A1 * | 8/2006 | Sjursen et al. | 381/322 |
| 2006/0218785 | A1 | 10/2006 | Horiuchi et al. | |
| 2006/0280320 | A1 | 12/2006 | Song et al. | |
| 2007/0098195 | A1 | 5/2007 | Holmes | |
| 2009/0163978 | A1 | 6/2009 | Miller, III et al. | |
| 2011/0243350 | A1 | 10/2011 | Miller, III et al. | |
| 2013/0010988 | A1 | 1/2013 | Miller, III et al. | |

* cited by examiner

PATTERNED IMPLANTABLE ELECTRET MICROPHONE

RELATED APPLICATIONS

This application claims priority to U.S. Provisional Application Ser. No. 61/173,275, filed Apr. 28, 2009, entitled "PATTERNED IMPLANTABLE ELECTRET MICROPHONE", the entirety of which is hereby incorporated by reference.

FIELD OF THE INVENTION

The present invention relates to the field of implantable hearing instruments, and in particular, to implantable electret microphones employable in fully- and semi-implantable hearing instrument systems.

BACKGROUND OF THE INVENTION

Traditional hearing aids are placed in a user's ear canal. The devices function to receive and amplify acoustic signals within the ear canal to yield enhanced hearing. In some devices, "behind-the-ear" units have been utilized which comprise a microphone to transduce the acoustic input into an electrical signal, some type of signal processing circuitry to modify the signal appropriate to the individual hearing loss, an output transducer (commonly referred to in the field as a "receiver") to transduce the processed electrical signal back into acoustic energy, and a battery to supply power to the electrical components.

Increasingly, a number of different types of fully- or semi-implantable hearing instruments have been developed. By way of example, implantable devices include instruments which employ implanted electromechanical transducers for stimulation of the ossicular chain and/or oval window, instruments which utilize implanted exciter coils to electromagnetically stimulate magnets fixed within the middle ear, and instruments which utilize an electrode array inserted into the cochlea to transmit electrical signals for sensing by the auditory nerve.

In these, as well as other implanted devices, acoustic signals are received by an implantable microphone, wherein the acoustic signal is converted to an electrical signal that is employed to generate a signal to drive an actuator that stimulates the ossicular chain and/or oval window or that is applied to selected electrodes of a cochlear electrode array. As may be appreciated, such implantable hearing instrument microphones must necessarily be positioned at a location that facilitates the receipt of acoustic signals and effective signal conversion/transmission. For such purposes, implantable microphones are most typically positioned in a surgical procedure between a patient's skull and skin, at a location rearward and upward of a patient's ear (e.g., in the mastoid region).

Given such positioning, the size and ease of installation of implantable hearing instrument microphones are primary considerations in the further development and acceptance of implantable hearing instrument systems. Further, it is important that a relatively high sensitivity and flat frequency response be provided to yield a high fidelity signal. Relatedly, the componentry cost of providing such a signal is of importance to achieving widespread use of implantable systems.

SUMMARY OF THE INVENTION

In view of the foregoing, a primary objective of the present invention is to provide an implantable microphone having a relatively small profile.

An additional objective of the present invention is to provide an implantable microphone that is reliable and cost effective.

Yet further objectives of the present invention are to provide an implantable microphone that provides high-sensitivity and relatively flat frequency response in acoustic signal conversion.

Yet another objective of the present invention is to provide an implantable microphone that provides directional sensitivity.

Yet another objective of the present invention is to provide an implantable microphone that provides a relatively higher gain at predetermined frequencies.

One or more of the above-noted objectives and additional advantages are realized by an implantable microphone of the present invention. The implantable microphone includes a hermetically-sealed, enclosed volume, and an electret member and back plate disposed with a space therebetween within the enclosed volume. The electret member and back plate are capacitively coupleable to provide an output signal indicative of acoustic signals incident upon at least one of the electret member and back plate. The electret arrangement yields a compact, and relatively low cost arrangement, while also providing a high quality output signal for use by an implantable hearing instrument.

As employed herein, an "electret member" is meant to refer to a microphone component having a dielectric material portion with a permanently-embedded static electric charge and an electrically-conductive material portion, or electrode. Further, a "back plate" is meant to refer to a microphone component having an electrically-conductive material portion, or electrode. When employed together in a microphone, the electret member and back plate may be disposed with the dielectric material portion of the electret member and the electrically-conductive material portion of the back plate located in opposing spaced relation and capacitively coupled, and with at least one of the electret member and back plate being moveable in response to acoustic signals incident thereupon, wherein electrical outputs from the electret member and back plate (e.g. from each of the electrodes) may be utilized to provide an electret output signal.

By way of example only, in a common source configuration, the electret member and back plate may be interconnected to a preamplifier (e.g., a FET) that is powered by a separate power source (e.g., an implantable, rechargeable battery). In turn, the preamplifier output may provide the electret output signal. The electret output signal may be processed and/or otherwise utilized to generate a drive signal applied to a transducer to stimulate a middle ear and/or inner ear component of a patient.

In one embodiment, the implantable microphone includes a hermetically-sealed, enclosed volume, and an electret member and back plate disposed with a space therebetween. The electret member and the back plate are capacitively coupleable to provide an output signal indicative of variations in the capacitive coupling across a lateral extent of the space in response to acoustic signals incident upon at least one of the electret member and the back plate. At least one of the electret member and the back plate includes a plurality of laterally offset portions located in corresponding spatial relation to a plurality of laterally offset regions comprising the lateral extent of the space. The output may be at least one of weighted and weightable in relation to the plurality of laterally offset portions.

In a related aspect, the electret member may include the plurality of laterally offset portions which may be defined by at least one of a dielectric material disposed in a predetermined pattern and an electrically conductive material (e.g., charge pick-up members) disposed in a predetermined pattern. The pattern may be determined by a set of substantially orthogonal radial and angular functions. A useful set of such functions are the solutions to the differential equations of motion for a surface in cylindrical coordinates commonly known as Bessel functions.

In one embodiment, the plurality of laterally offset portions is defined by a predetermined pattern of a dielectric material. The pattern may include at least one of a plurality of spaced dielectric material patches and a dielectric material disposed in a complex-configuration pattern. The complex-configuration pattern may include a uniform pattern, the boundaries of which are the zeros of linear sums of substantially orthogonal radial and angular functions; a uniform pattern, the area of which provides a response proportional to the integral of the linear sums and placed within the boundary of the zeros; a uniform density interdigitated pattern with boundaries formed by the zeros; and a non-uniform density interdigitated pattern bound by the zeros, the density of which is proportional to the amplitude of the linear sums. The linear weighting of the functions may be chosen from the modes of the surface responsive to acoustic pressures response to a desired spectrum or direction of arrival.

In a related embodiment, the predetermined pattern of dielectric material includes a plurality of spaced dielectric material patches that are at least one of located and sized to weight the output in a predetermined manner. For example, the patches may be located in an array pattern selected from the group consisting of an interdigitated pattern bound by the zeros and connected by the sign of linear sums of substantially orthogonal radial and angular functions; and an interdigitated pattern bound by the zeros and connected by the sign of the linear sums of the functions, the relative area or density of which is determined by the amplitude of the linear sums, and the polarity of which is determined by the sign of the linear sums in the area bound by the zeros. The plurality of patches may also provide a plurality of outputs. In this regard, the microphone may further include at least one signal conditioner for conditioning at least one of the plurality of outputs to weight the output signal in a predetermined manner.

In another embodiment, the plurality of laterally offset portions is defined by a predetermined pattern of an electrically conductive material. The pattern may include at least one of a plurality of spaced electrically conductive material patches and an electrically conductive material disposed in a complex-configuration pattern. The complex-configuration pattern may include a uniform pattern, the boundaries of which are the zeros of linear sums of substantially orthogonal radial and angular functions; a uniform pattern, the area of which provides a response proportional to the integral of the linear sums and placed within the boundary of the zeros; a uniform density interdigitated pattern with boundaries formed by the zeros; and a non-uniform density interdigitated pattern bound by the zeros, the density of which is proportional to the amplitude of the linear sums. The linear weighting of the functions may be chosen from the modes of the surface responsive to acoustic pressures response to a desired spectrum or direction of arrival.

In a related embodiment, the predetermined pattern of electrically conductive material includes a plurality of spaced electrically conductive material patches that are at least one of located and sized to weight the output in a predetermined manner. For example, the patches may be located in an array pattern selected from the group consisting of an interdigitated pattern bound by the zeros and connected by the sign of linear sums of substantially orthogonal radial and angular functions; and an interdigitated pattern bound by the zeros and connected by the sign of the linear sums of the functions, the relative area or density of which is determined by the amplitude of the linear sums, and the polarity of which is determined by the sign of the linear sums in the area bound by the zeros. The plurality of patches may also provide a plurality of outputs. In this regard, the microphone may further include at least one signal conditioner for conditioning at least one of the plurality of outputs to weight the output signal in a predetermined manner.

In yet another embodiment, the back plate includes the plurality of laterally offset portions, which are defined by an electrically conductive material disposed in a predetermined pattern. The pattern may include at least one of a plurality of spaced electrically conductive material patches and an electrically conductive material disposed in a complex-configuration pattern. The complex-configuration pattern may include a uniform pattern, the boundaries of which are the zeros of linear sums of substantially orthogonal radial and angular functions; a uniform pattern, the area of which provides a response proportional to the integral of the linear sums and placed within the boundary of the zeros; a uniform density interdigitated pattern with boundaries formed by the zeros; and a non-uniform density interdigitated pattern bound by the zeros, the density of which is proportional to the amplitude of the linear sums. The linear weighting of the functions may be chosen from the modes of the surface responsive to acoustic pressures response to a desired spectrum or direction of arrival.

In a related embodiment, the predetermined pattern of electrically conductive material includes a plurality of spaced electrically conductive material patches that are at least one of located and sized to weight the output in a predetermined manner. For example, the patches may be located in an array pattern selected from the group consisting of an interdigitated pattern bound by the zeros and connected by the sign of linear sums of substantially orthogonal radial and angular functions; and an interdigitated pattern bound by the zeros and connected by the sign of the linear sums of the functions, the relative area or density of which is determined by the amplitude of the linear sums, and the polarity of which is determined by the sign of the linear sums in the area bound by the zeros. The plurality of patches may also provide a plurality of outputs. In this regard, the microphone may further include at least one signal conditioner for conditioning at least one of the plurality of outputs to weight the output signal in a predetermined manner.

In another embodiment, the electret member of the microphone may include a plurality of laterally offset portions that may include at least one positively charged dielectric material portion and at least one negatively charged dielectric material portion. Further, the plurality of laterally offset portions may be disposed in a predetermined pattern.

In a related aspect, the at least one positively charged dielectric material portion and the at least one negatively charged dielectric material portion may be at least one of located and sized to weight an output signal in a predetermined matter. Further, the at least one positively charged dielectric material portion may provide at least a first output within the enclosed volume and the at least one negatively charged dielectric material portion may provide at least a second output within the enclosed volume, wherein the first output and the second output are employable to generate an output signal.

In another embodiment, the plurality of laterally offset portions may provide a plurality of outputs that are employable to generate the output signal, wherein the output signal reflects a predetermined directional sensitivity to acoustic signals. In this regard, the plurality of laterally offset portions may be at least one of located and sized to provide the predetermined directional sensitivity. Further, the microphone may include at least one signal conditioner for conditioning at least one of the plurality of outputs in a predetermined manner to provide the predetermined directional sensitivity. The predetermined directional sensitivity may be based, at least in part, upon physical attributes of a patient (e.g., the direction dependent frequency shaping of a patient's pinna).

In a related aspect, at least one of the electret member and the back plate may be flexible and tensioned along at least a first tension axis that extends across the at least one of the electret member and back plate. Further, the plurality of portions may be located a predetermined spatial relation to the at least a first tension axis to provide, at least in part, a predetermined directional sensitivity.

Additional aspects and corresponding advantages will be apparent to those skilled it the art upon consideration of the further description that follows.

DETAILED DESCRIPTION OF THE INVENTION

Figure 1:
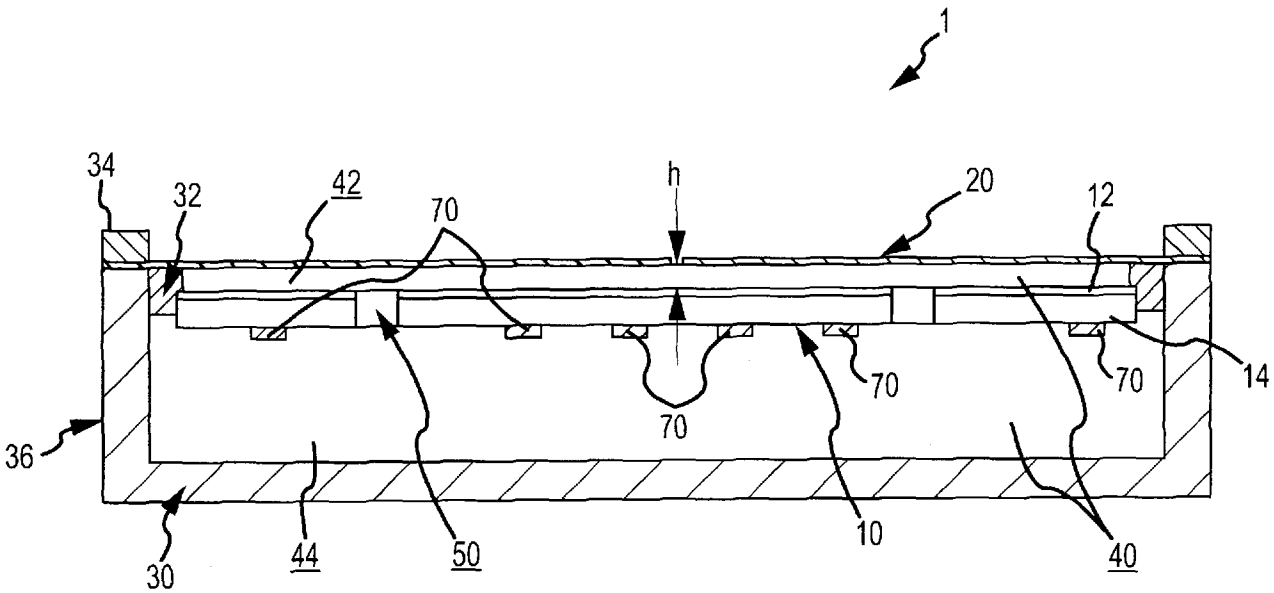
FIG. 1 illustrates a cross-sectional side view of one embodiment of an implantable microphone of the present invention.
Figure 2:
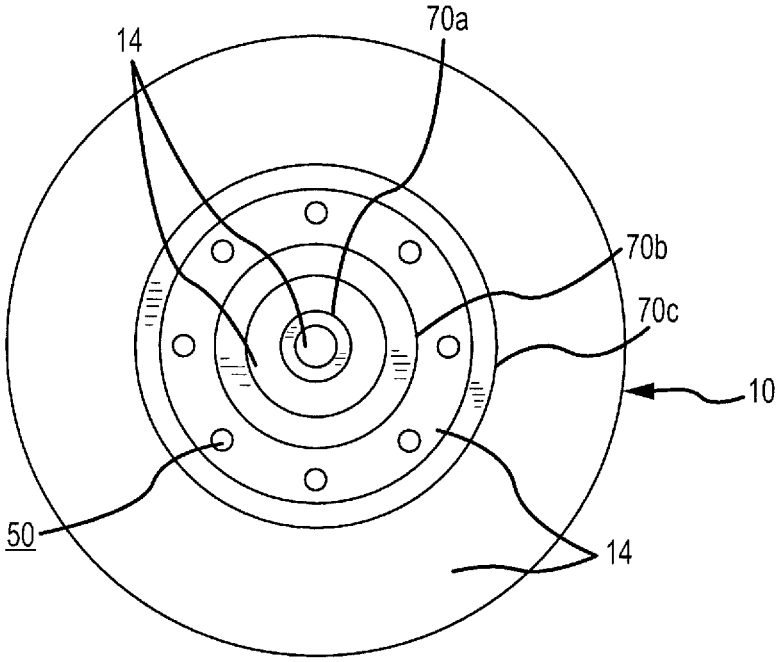
FIG. 2 illustrates a bottom view of the electret member of the embodiment of FIG. 1.

FIGS. 1 and 2 illustrate one embodiment of the present invention. The implantable microphone 1 includes an electret member 10 and a flexible diaphragm 20, which comprises a back plate. The flexible diaphragm 20 extends across an opening of a biocompatible housing 30 and is peripherally secured in such position between a clamp ring 32 and interconnected (e.g. via laser welding) to a cup-shaped lower housing member 36. The diaphragm 20 and housing 30 define a hermetically-sealed, enclosed volume 40 that includes a first portion 42 located on a first side of the electret member 10 and a second portion 44 located on an opposing second side of the electret member 10. The first portion 42 and second portion 44 may be fluidly interconnected by one or more vents 50 that extend through the electret member 10.

As shown in FIG. 1, the electret member 10 and the diaphragm 20 comprising the back plate may be spaced by a relatively small distance h that comprises the enclosed volume 40. In turn, the electret member 10 and back plate of diaphragm 20 may be capacitively coupleable to provide an output signal indicative of the external acoustic signals incident upon the flexible diaphragm 20.

By way of example only, in a common source configuration, the electret member 10 and back plate of the diaphragm 20 may each be electrically interconnected to a preamplifier (e.g., a FET) that is powered by a separate power source (e.g., an implantable, rechargeable battery). In turn, the preamplifier output may provide an electret output signal. In turn, such output signal may be utilized to generate a drive signal for an implanted hearing aid instrument (e.g., an electromechanical or electromagnetic transducer for middle ear stimulation or a cochlear electrode array).

The electret member 10 may be of a non-flexible construction and disposed in fixed relation to the housing 30. Further, the electret member 10 may be electrically insulated from the housing 30 and back plate of the flexible diaphragm 20 by one or more peripheral insulating member(s) 32. Such peripheral member(s) 32, or other components, may also be disposed to engage and thereby facilitate positioning and tensioning of the diaphragm 20 at a desired distance h from the electret member 10, as shown in FIG. 1, and further discussed below.

The electret member 10 may comprise a charged dielectric material layer 12 and an electrode 14 (e.g., a metal plate or metallized support member). By way of example, the dielectric material layer 12 may comprise a permanently-charged, halocarbon polymer such as polyfluoroethylenepropylene. The diaphragm 20 may comprise an electrically-conductive material, e.g., a biocompatible metal such as titanium, wherein the diaphragm 20 may integrally define the back plate. In other arrangements, a separate metal layer defining the electrode of the back plate may be provided on an internal side of the diaphragm 20.

A plurality of spaced, electrically-conductive members 70, i.e., electrical pick-up members, are included. In this regard, electrically-conductive members 70 may be combinatively employed to provide a first electrical output from electret member 10 that is employed with a second electrical output from the back plate of diaphragm 20 to provide an electret output signal. By way of example, the electrically-conductive members 70 may be electrically interconnected in parallel, wherein the electrical output of each of the electrically-conductive members 70 will reflect a corresponding measure of capacitive coupling between the electret member 10 and back plate of diaphragm 20 in the corresponding spatial regions of the dielectric layer 12 that adjacently oppose the electrically-conductive members 70. In turn, the electrically-conductive members 70 may be located in corresponding relation to a predetermined plurality of acoustic vibration frequency ranges that correspond with differing distance ranges relative to a center axis of the microphone, thereby facilitating the provision of an improved electret output signal.

The electrically-conductive members 70 may be provided in the form of three spaced rings 70*a*, 70*b* and 70*c*, as shown in FIG. 2, which is a bottom view of the electret member 10. As illustrated, the electrically-conductive rings 70*a*, 70*b* and 70*c* may be concentrically disposed about a center axis of the electret member 10 and the diaphragm 20.

Of note, while the embodiment shown in FIGS. 1 and 2 includes vents 50, other embodiments utilizing electrically-conductive members 70 need not include vents 50 or an enclosed volume that comprises more than a single portion. Further, while the embodiment of FIGS. 1 and 2 illustrate electrically-conductive members on the electret member 10, other implantable microphone embodiments may provide for the placement and use of spaced electrically-conductive members on the back plate 20.

Figure 3:
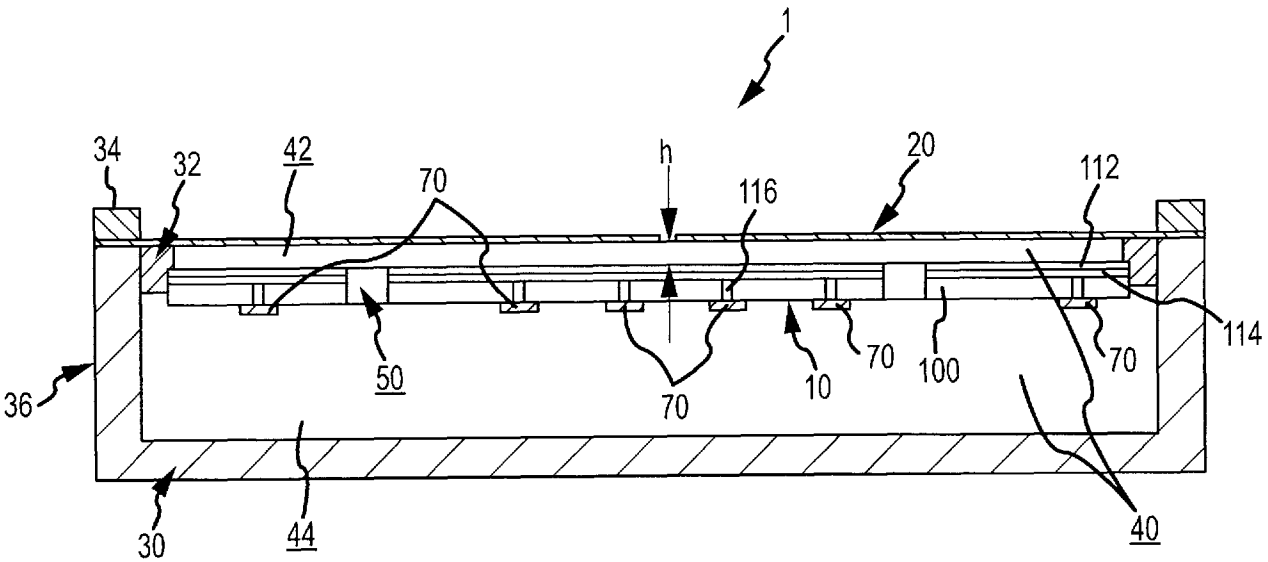
FIG. 3 illustrates a cross-sectional side view of another embodiment of an implantable microphone of the present invention.

Referring now to FIG. 3, an alternative approach for defining an electret member 10, employable in the embodiment of FIGS. 1 and 2, will be described. In particular, an electrically non-conductive support member 100 may be provided. In turn, an electrically-conductive, metallized layer may be disposed thereupon to define electrode 114, and in turn, a dielectric coating layer 112 may be disposed thereupon. Further, electrically-conductive members 70 may be disposed on a bottom side of the support layer 100 via a metallization process. The electrically-conductive members 70 may be electrically interconnected to electrode 114 via electrically-conductive through-holes 116 provided through the support member 100. As may be appreciated, the embodiment of FIG. 3 may comprise a printed circuit board arrangement to define the electret member 10.

Figure 4:
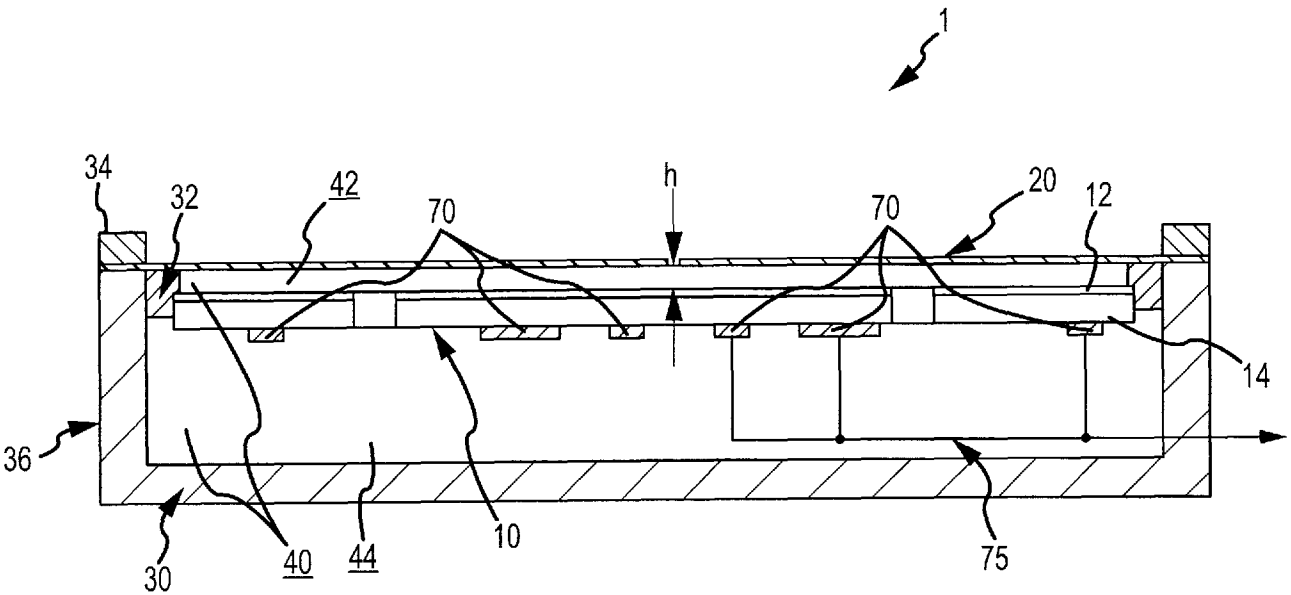
FIG. 4 illustrates a cross-sectional side view of another embodiment of an implantable microphone of the present invention.

Another embodiment of the present invention is illustrated in FIG. 4. In this embodiment, the plurality of spaced, electrically-conductive members are electrically coupled together by a conductive member 75 (e.g., a wire). In this regard, the output signal on the conductive member 75 may be a weighted sum of the signals produced on the electrically-conductive members 70. That is, the output signal may comprise a sum of the individual capacitive coupling at each of the three electrically-conductive members 70 that is weighted by the relative area of each of the members 70.

In the embodiment shown in FIG. 4, the conductive members 70 may be sized and/or located such that the resulting output signal at the conductive member 75 has a desired frequency response. As shown, the electrically-conductive members 70 may be provided in the form of three, individually sized, spaced rings. The electrically-conductive rings 70 may be concentrically disposed about a center axis of the electret member 10 and the diaphragm 20. By providing electrically-conductive members 70 in the form of rings (or other shapes) of different sizes, the relative gain of the composite output signal due to each electrically-conductive member 70 may be different. For example, as shown, the middle concentric ring 70 is substantially larger than the inner and outer concentric rings 70. Therefore, given the same change in distance h between the electret member 10 and the diaphragm 20, the electrically-conductive member 70 in the middle ring will produce a larger output signal than the inner and outer rings. This may be desirable for several reasons. For example, the deflection between the electret member 10 and the diaphragm 20 may vary as a function of the radius from the central axis and frequency. By positioning an electrically-conductive member 70 at a point that is known to have a relatively large deflection caused by a acoustic signal at a frequency that is desired to be amplified, the sensitivity of the microphone may be increased. As another example, certain regions may deflect in response to acoustic vibrations that have the effect of cancelling deflections in another region. In this regard, the electrically conductive members 70 may be located and/or sized to reduce the cancellation effects, which may also increase the sensitivity of the microphone 1.

Figure 5:
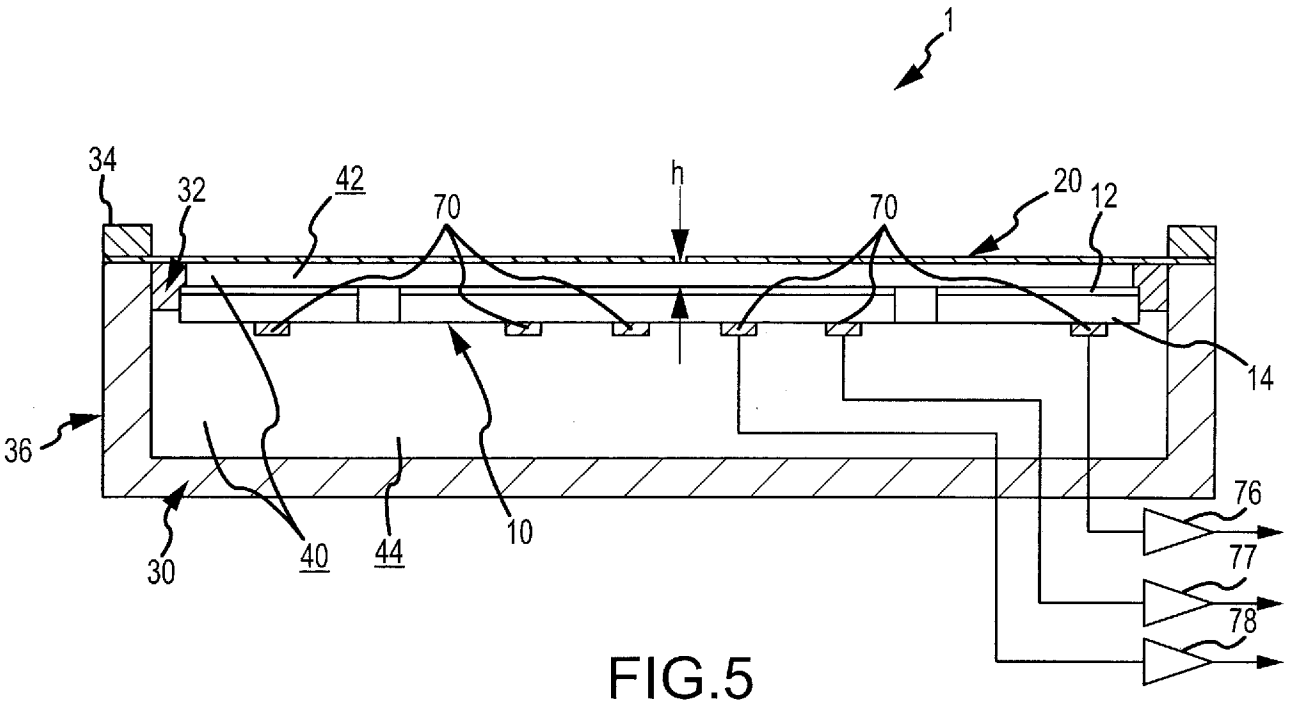
FIG. 5 illustrates a cross-sectional side view of another embodiment of an implantable microphone of the present invention.

FIG. 5 illustrates another embodiment, wherein components that correspond to components in the embodiment of FIG. 4 are referred to with corresponding reference numerals. In this embodiment, each of the plurality of electrically-conductive members 70 is fed into processing stages 76, 77, and 78. In this regard, the gain of the composite output signal for the microphone 1 may be varied independently for each electrically-conductive member 70. Further, the gain may be individually varied independent of the size and location of each electrically-conductive member 70. As can be appreciated, the gain of each amplification stage 76-78 may be predetermined, adjustable by a patient or a technician, or a combination thereof. In addition to amplification, the processing stages 76-78 may also perform additional functions, including but not limited to phase shifting, filtering, or the like.

The processing stages 76-78 shown may be used to finely tune the frequency response of the microphone 1. For example, the electrically conductive members 70 may be sized and/or located to provide a relatively flat frequency response across a desirable range of frequencies. However, it may be difficult to achieve the optimum response by sizing and locating the members 70 alone. This may be due to mechanical variations, individual patient physical variations, individual patient frequency sensitivity, or other issues. Thus, the processing stages 76-78 may be used to selectively amplify the output signals to provide a better performing microphone 1 for an individual patient.

Figure 6A:
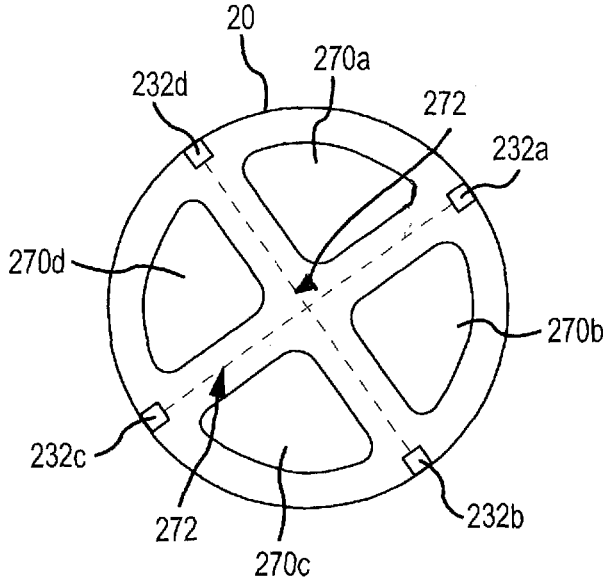
FIG. 6A illustrates a bottom view of an electret member of an embodiment of the present invention.
Figure 6B:
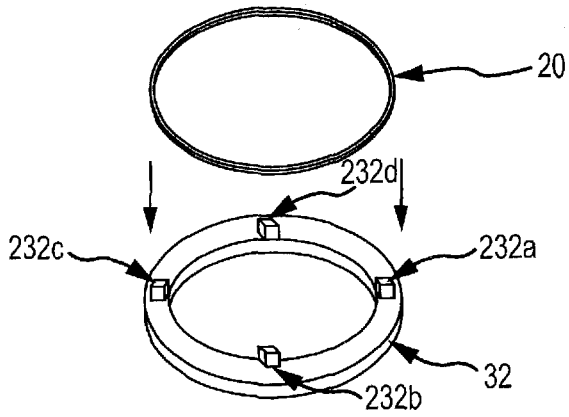
FIG. 6B illustrates an assembly view of a clamp ring and a diaphragm of the electret member embodiment shown in FIG. 6A.

FIG. 6A illustrates a bottom view of a diaphragm 20 of the present invention. In this embodiment, the diaphragm 20 is flexible and is tensioned along tension axes 272 that extend across the diaphragm 20. A plurality of spaced, electrically-conductive members 270*a-d* are located in predetermined spatial relation to the tension axes 272 to provide, at least in part, a predetermined directional sensitivity. To provide the tension required to form the tension axes 272, a clamp ring 32 as shown in FIG. 6B and employable in various described embodiments, may include four raised portions 232*a-d* that are spaced 90 degrees apart along the periphery of the clamp ring 32. In this regard, when the diaphragm 20 is stretched over the clamp ring 32, the tension on the surface of the diaphragm 20 due to the raised portions 232*a-d* forms the tension axes 272. It will be appreciated that the number and spacing of the raised portions 232 may be varied to achieve a desired directional characteristic.

As can be appreciated, the tension axes 272 function to partition the surface of the diaphragm 20 into a plurality of laterally offset regions. In this regard, each region may serve as an element in an array of acoustic sensors, such that the response of the diaphragm 20 due to acoustic signals may be controlled to provide desirable properties, such as directional sensitivity, a predetermined frequency response, improved sensitivity, or other characteristics. In one embodiment, at least one of the tension axes 272 and the spaced, electrically-conductive members 270*a-d* are designed to provide directional sensitivity that corresponds to a physical characteristic of a patient (e.g., the direction dependent frequency response resulting from the shape of a patient's pinna).

As discussed above, the tension axes 272 operate to divide the diaphragm 20 into partitions (e.g., an array of acoustic sensors) that may be utilized to provide directional sensitivity by using, for example, beamforming techniques. Generally, beamforming (e.g., a phased array) takes advantage of the fact that the distance from an acoustic source and each element in the array is slightly different. This results in the acoustic signals arriving at each element at slightly different times, such that the output signals from each element are phase shifted relative to each other. Various mathematical techniques may be used to determine the direction of an acoustic source by analyzing the plurality of phase-shifted signals. For example, the microphone 1 may be designed so that acoustic signals that originate directly in front of a patient are amplified to a greater extent than signals from behind the patient, such that the patient may more clearly hear a conversation with another person.

In addition to directional sensitivity, the array of acoustic sensors may be used to simulate a physical characteristic of a patient. For example, the array may be designed to simulate the function of a patient's pinna. In addition to collecting sound, the pinna functions to filter the sound in a way that adds directional information. Specifically, the filtering process preferentially amplifies sounds in the frequency range of human speech. Thus, the array may be designed to model the human pinna to achieve the same desirable frequency response. Additionally, the pinna and surrounding structures filter sounds in a directionally dependent way, so that a given direction corresponds to a specific frequency shaping. The array may be designed so as to produce the frequency shaping corresponding to a given direction (e.g. its direction of greatest sensitivity).

To achieve the aforementioned beamforming functionality, tension axes may be provided in any desirable quantity and position. Further, electrically-conductive members may be sized and/or located to provide the desired response. Additionally or alternatively, the functionality may be achieved using various signal processing techniques. For example, the plurality of output signals from the plurality of electrically-conductive members may be processed in the time domain (e.g., using "delay and sum") or frequency domain (e.g., using FFT or a filter bank).

Figure 7:
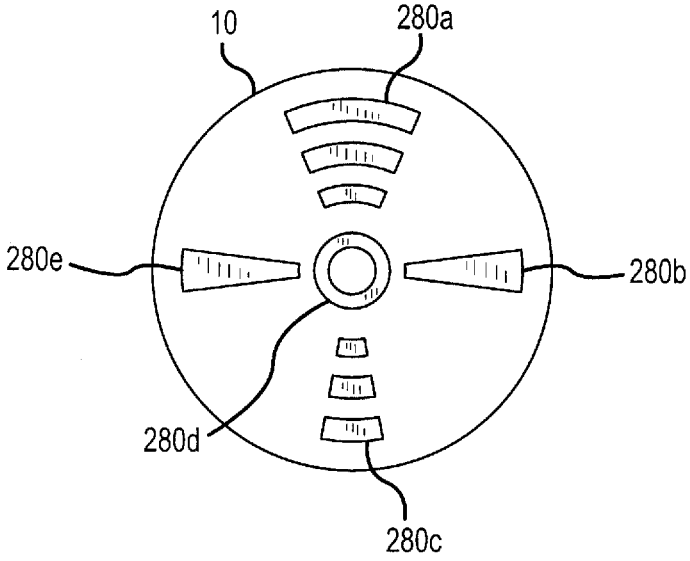
FIG. 7 illustrates a bottom view of another electret member of an embodiment of the present invention.

FIG. 7 illustrates a bottom view of another electret member 10 of the present invention. In this embodiment, the electret member 10 includes a plurality of spaced, electrically-conductive members 280*a-e* that are disposed in various patterns. In this regard, the plurality of members 280*a-e* are spaced in various patterns that may be desirable to achieve various functional characteristics that may include directional sensitivity, a predetermined frequency response, improved sensitivity, or other characteristics. Such patterns may be employed separately or in different combinations.

Figure 8:
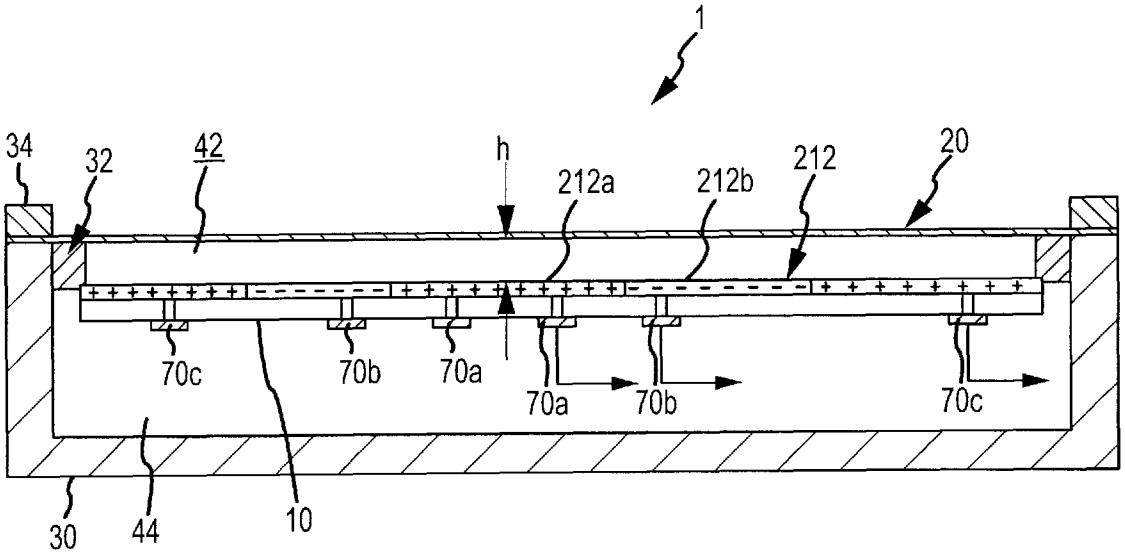
FIG. 8 illustrates a cross-sectional side view of another embodiment of an implantable microphone of the present invention.

FIG. 8 illustrates another embodiment, wherein components that correspond to components in the embodiment of FIG. 4 are referred to with corresponding reference numerals. In this embodiment, an electret member 212 includes a plurality of laterally offset portions that include positively charged dielectric material portions (e.g., portion 212*a*) and negatively charged dielectric material portions (e.g., portion 212*b*) that are disposed in a predetermined pattern. As in previously described embodiments, the positively and negatively charged dielectric portions may be at least one of located and sized to weight an output signal of the microphone 1.

In this embodiment, the electrically-conductive member 70*a* may be coupled to the positively charged dielectric material portion 212*a*, to provide a first output within the enclosed volume of the microphone 1. Similarly, the electrically conductive member 70*b* may be coupled to the negatively charged dielectric material portion 212*b*, to provide a second output within the enclosed volume. In this regard, the first output and the second output may be employed to generate an output signal of the microphone 1. As can be appreciated, this configuration may provide an electret output signal entirely from a single side of the electret member 10 (e.g., within the volume 44), which may reduce the volume requirements and the complexity of the design for the microphone 1 by not requiring any electrical connections on the back plate 20.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain known modes of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

What is claimed is:

1. An implantable microphone comprising:

a hermetically-sealed, enclosed volume;

an electret member and a back plate disposed with a space therebetween and capacitively coupleable to provide an output signal indicative of variations in said capacitive coupling across a lateral extent of said space in response to acoustic signals incident upon at least one of the electret member and back plate, said space being within said enclosed volume, wherein at least one of said electret member and said back plate comprises a plurality of laterally offset portions located in corresponding spatial relation to a plurality of laterally offset regions comprising said lateral extent of said space.

2. The implantable microphone of claim 1, wherein said output signal is at least one of weighted and weightable in relation to said plurality of laterally offset portions.

3. The microphone of claim 2, wherein said electret member comprises said plurality of laterally offset portions which are defined by at least one of the following:

a dielectric material disposed in a predetermined pattern; and an electrically conductive material disposed in a predetermined pattern.

4. The microphone of claim 3, wherein said plurality of laterally offset portions is defined by a predetermined pattern of a dielectric material, said pattern comprising at least one of the following:

a plurality of spaced dielectric material patches; and a dielectric material disposed in a complex-configuration pattern.

5. The microphone of claim 4, wherein said dielectric material is disposed in a complex-configuration pattern selected from a group consisting of:

a uniform pattern, the boundaries of which are the zeros of linear sums of substantially orthogonal radial and angular functions;

a uniform pattern, the area of which provides a response proportional to the integral of said linear sums and placed within the boundary of said zeros;

a uniform density interdigitated pattern with boundaries formed by said zeros; and a non-uniform density interdigitated pattern bound by said zeros, the density of which is proportional to the amplitude of said linear sums;

wherein the linear weighting of said functions is chosen from the modes of the surface responsive to acoustic pressures response to a desired spectrum or direction of arrival.

6. The microphone of claim 4, wherein said patches are located in an array pattern selected from a group consisting of:

an interdigitated pattern bound by the zeros and connected by the sign of linear sums of substantially orthogonal radial and angular functions; and an interdigitated pattern bound by the zeros and connected by the sign of the linear sums of said functions, the relative area or density of which is determined by the amplitude of the linear sums, and the polarity of which is determined by the sign of the linear sums in the area bound by the zeros.

7. The microphone of claim 4, wherein said plurality of patches provide a plurality of outputs, and further comprising:

at least one signal conditioner for conditioning at least one of said plurality of outputs to weight said output signal in a predetermined manner.

8. The microphone of claim 3, wherein said plurality of laterally offset portions is defined by a predetermined pattern of an electrically conductive material, said pattern comprising at least one of the following:

a plurality of spaced electrically conductive material patches; and an electrically conductive material disposed in a complex-configuration pattern.

9. The microphone of claim 8, wherein said electrically conductive material is disposed in a complex-configuration pattern selected from a group consisting of:

a uniform pattern, the boundaries of which are the zeros of linear sums of substantially orthogonal radial and angular functions;

a uniform pattern, the area of which provides a response proportional to the integral of said linear sums and placed within the boundary of said zeros;

a uniform density interdigitated pattern with boundaries formed by said zeros; and a non-uniform density interdigitated pattern bound by said zeros, the density of which is proportional to the amplitude of said linear sums;

wherein the linear weighting of said functions is chosen from the modes of the surface responsive to acoustic pressures response to a desired spectrum or direction of arrival.

10. The microphone of claim 8, wherein said plurality of patches are at least one of located and sized to weight said signal output in a predetermined manner.

11. The microphone of claim 10, wherein said patches are located in an array pattern selected from a group consisting of:

an interdigitated pattern bound by the zeros and connected by the sign of linear sums of substantially orthogonal radial and angular functions; and an interdigitated pattern bound by the zeros and connected by the sign of the linear sums of said functions, the relative area or density of which is determined by the amplitude of the linear sums, and the polarity of which is determined by the sign of the linear sums in the area bound by the zeros.

12. The microphone of claim 2, wherein said back plate comprises said plurality of laterally offset portions which are defined by an electrically conductive material disposed in a predetermined pattern.

13. The microphone of claim 12, said predetermined pattern comprising at least one of the following:

a plurality of spaced electrically conductive material patches; and an electrically conductive material disposed in a complex-configuration pattern.

14. The microphone of claim 13, wherein said electrically conductive material is disposed in a complex-configuration pattern selected from a group consisting of:

a uniform pattern, the boundaries of which are the zeros of linear sums of substantially orthogonal radial and angular functions;

a uniform pattern, the area of which provides a response proportional to the integral of said linear sums and placed within the boundary of said zeros;

a uniform density interdigitated pattern with boundaries formed by said zeros; and a non-uniform density interdigitated pattern bound by said zeros, the density of which is proportional to the amplitude of said linear sums;

wherein the linear weighting of said functions is chosen from the modes of the surface responsive to acoustic pressures response to a desired spectrum or direction of arrival.

15. The microphone of claim 13, wherein said plurality of patches are at least one of located and sized to weight said output signal in a predetermined manner.

16. The microphone of claim 15, wherein said patches are located in an array pattern selected from a group consisting of:

an interdigitated pattern bound by the zeros and connected by the sign of linear sums of substantially orthogonal radial and angular functions; and an interdigitated pattern bound by the zeros and connected by the sign of the linear sums of said functions, the relative area or density of which is determined by the amplitude of the linear sums, and the polarity of which is determined by the sign of the linear sums in the area bound by the zeros.

17. The microphone of claim 13, wherein said plurality of patches provide plurality of output, and further comprising:

at least one signal conditioner for conditioning at least one of said plurality of outputs to weight said output signal in a predetermined manner.

18. The microphone of claim 1, wherein said electret member comprises said plurality of laterally offset portions, and wherein said plurality of laterally offset portions comprise:

at least one positively charged dielectric material portion; and, at least one negatively charged dielectric material portion.

19. The microphone of claim 18, wherein said at least one positively charged dielectric material portion and said at least one negatively charged dielectric material portion are disposed in a predetermined pattern.

20. The microphone of claim 18, wherein said at least one positively charged dielectric material portion provides at least a first output within said enclosed volume and said at least one negatively charged dielectric material portion provides at least a second output within said enclosed volume, and wherein said first output and said second output are employable to generate said output signal.

21. The microphone of claim 1, wherein said plurality of laterally offset portions provide a plurality of outputs, employable to generate said output signal, and wherein said output signal reflects a predetermined directional sensitivity to said acoustic signals.

22. The microphone of claim 21, wherein said plurality of laterally offset portions are at least one of located and sized to provide said predetermined directional sensitivity.

23. The microphone of claim 22, wherein said electret member comprises said plurality of laterally offset portions which are defined by at least one of the following:

a dielectric material disposed in a predetermined pattern; and an electrically conductive material disposed in a predetermined pattern.

24. A hearing prosthesis, comprising:

the implantable microphone of claim 1.

* * * * *